United States Patent [19]

Ayers

[11] 3,983,523

[45] Sept. 28, 1976

[54] COMBINATION STATIC PLATE AND CLAMPING RING

[75] Inventor: Ralph E. Ayers, Rome, Ga.

[73] Assignee: General Electric Company

[22] Filed: Nov. 3, 1975

[21] Appl. No.: 627,901

[52] U.S. Cl. ..... 336/84; 174/35 CE; 336/197; 336/210; 336/212

[51] Int. Cl.[2] ..... H01F 15/04

[58] Field of Search ..... 336/197, 212, 84, 210, 336/219; 174/35 CE

[56] References Cited

UNITED STATES PATENTS

| | | | |
|---|---|---|---|
| 2,907,965 | 10/1959 | Mercier | 336/84 |
| 2,933,551 | 4/1960 | Kramer | 336/84 X |
| 3,366,907 | 1/1968 | Tipton | 336/197 |

*Primary Examiner*—Thomas J. Kozma
*Attorney, Agent, or Firm*—John J. Kelleher

[57] ABSTRACT

A clamping ring and static plate used for axially compressing the ends of a cylindrically shaped power transformer winding. The electrically conductive static plate portion of the combination device is formed around and is insulated from a foundation providing, high-strength material, clamping ring. In addition to saving material and space, the use of two or more of these devices concentrically positioned, permits the application of unequal clamping forces to concentrically positioned windings; at least one of these devices having reduced insulation requirements.

6 Claims, 6 Drawing Figures

COMBINATION STATIC PLATE AND CLAMPING RING

BACKGROUND OF THE INVENTION

The present invention relates generally to power transformers of the helical or disc wound type and particularly to an improved static plate and clamping ring device for such windings.

It is well known that highly inductive windings, such as iron core transformer windings, when exposed to steep wave front or surge voltages, initially exhibit an exponential distribution of voltage drop along the length of the winding with a very high voltage gradient across the first few turns adjacent the line terminal or high voltage end of the winding. This non-uniform distribution of surge voltages is undesirable, as it necessitates thicker insulation at the high voltage end than at the low voltage end of such a winding. Size and cost of electrical apparatus are thus adversely affected. One well known and fairly standard partial solution to this problem, is the placement of a potential distributing static plate adjacent the high voltage end of a winding, with said static plate being electrically connected to a high voltage winding terminal. With such an arrangement, voltages applied to a winding of this type are capacitively coupled to the turns at the high voltage end of the winding which has the effect of increasing winding series capacitance, resulting in an improved distribution of such applied voltages. The static plate normally consists of paper tape having an aluminum foil backing, said foil backed paper tape being wrapped in a generally radial direction on a foundation ring of fiberboard or other electrical non-conducting material, said foundation ring being toroidal in shape in that it is in the form of a flat washer. The static plate, including its foundation ring, is placed adjacent the high voltage end of a winding of the above-mentioned type, and the aluminum or metal backing portion of the static plate is electrically connected to a high voltage winding terminal.

In addition to the above-mentioned static plate, it is necessary to provide means for clamping windings, of the above-mentioned type, along their longitudinal axes to control winding damaging axial movement of same. One technique is to place a plurality of insulated steel plates, sometimes referred to as quadrant plates, circumferentially around and adjacent the upper static plate surface or that surface of the static plate that is furtherest away from the high voltage end of the winding on which said static plate has been placed, said quadrant plates being, essentially, equally spaced-apart around said upper surface of said static plate. After the quadrant plates are in place, a jackscrew or other such device, reacted against fixed structure, is used to apply a force to the quadrant plate which, in turn, applies a compressive force to the adjacent static plate and associated windings. For mechanical stability and for economic reasons a single set of quadrant plates is used to simultaneously clamp high voltage, low voltage and other types of windings. Other clamping plates are in the form of semi-circles which necessitate the use of two such plates per phase winding. Using such plates to simultaneously clamp many types of windings, makes it essential that they be sufficiently insulated to withstand the highest voltage that any of these windings might be subjected to. In addition, each one of the quadrant plates, for example, must be separately positioned prior to being clamped in place, which is normally a time consuming task.

The use of a fiberboard or a permawood type material for the static plate foundation ring and the use of quadrant or semi-circular plates for clamping the end of a transformer winding necessitates the use of more material and space than would otherwise be used if a combined structural member provided these functions. In addition, if such a structural member was ring shaped it would provide the radial stability that is lacking in a quadrant or semi-circular plate arrangement. A ring-shaped structure would make possible the application of unequal compressive clamping forces to the high voltage low voltage and other windings, and would make it unnecessary to insulate all such clamping devices in a transformer for the same voltage withstand capability.

SUMMARY OF THE INVENTION

In accordance with the present invention, the functions of a static plate and clamping ring, in a power transformer, are combined in a single device to effect significant savings in space and materials. The clamping ring portion of the device consists of a high-strength material ring, said ring having a ring severing slot therein, if made of an electrically conductive material, to avoid the well-known problem associated with locating a closed electrical turn in a magnetic field. To maintain clamping ring radial strength, the slot cut in such a clamping ring is filled with a high strength, transformer-oil compatible material such as an epoxy resin. In addition to its clamping function, the ring also serves as a foundation for the static plate portion of the device, said static plate being formed around said clamping ring. The use of two or more of these devices enables one to apply unequal clamping forces to concentrically positioned windings without having to insulate all such devices for the highest voltage to be applied to any one of the clamped windings. This is so because each winding would have its own combination device and each device would only be subjected to the voltage of a single winding.

DESCRIPTION OF THE PREFERRED EMBODIMENT

Figure 1:
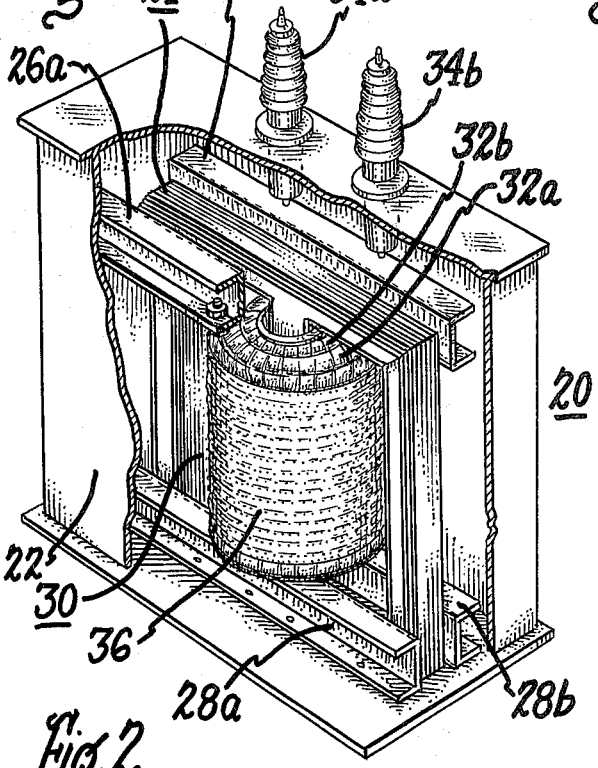
FIG. 1 is a partially broken away perspective view of a single phase power transformer incorporating two concentric combination static plate and clamping ring devices of the present invention.

Referring now to the drawings wherein like numerals are used to indicate like parts throughout, in FIG. 1 a partially broken away perspective view of single phase power transformer 20, incorporating two of the combination static plate and clamping ring devices of the present invention, is depicted. Power transformer 20 includes tank 22 enclosing three-legged stacked core 24, upper clamping bars 26*a*, 26*b*, lower clamping bars 28*a*, 28*b*, high and low voltage windings 30 disposed around the central leg of said three-legged stacked core 24, transformer insulating and cooling oil (not shown) and concentrically positioned, outer and inner combination static plate and clamping ring devices 32*a*, 32*b*, in a preferred embodiment of the present invention. Clamping bars 26*a*, 26*b*, 28*a*, and 28*b* are in a fixed position with respect to core 24 and with respect to transformer tank 22. In addition, a set of electrical bushings 34*a*, 34*b* extend through the top of said transformer tank 22 to pass electrical power therethrough. The positioning of outer combination static plate and clamping ring 32*a* and its relationship to outer or high voltage winding 36, can more clearly be seen in FIG. 2.

Figure 2:
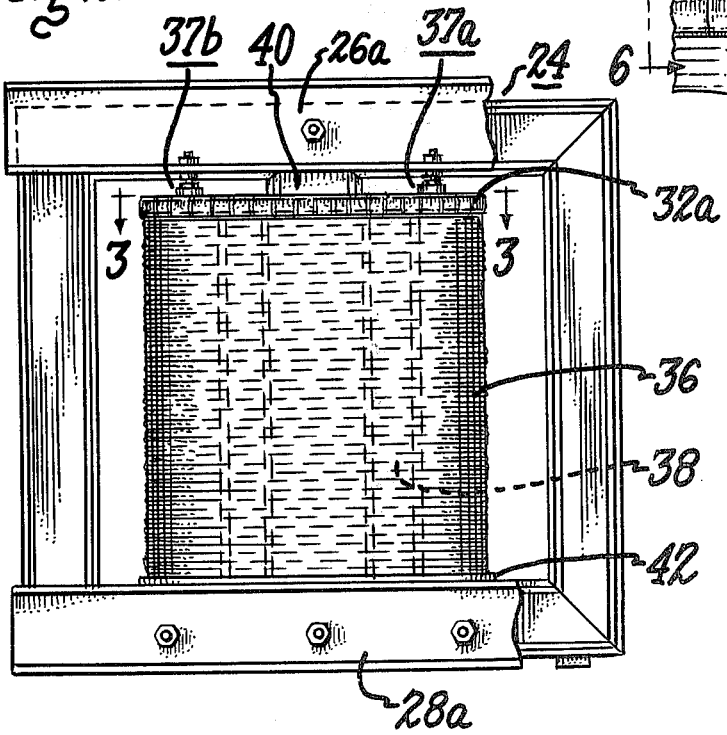
FIG. 2 is a front elevation, partially broken away, of the winding, core, clamping structure and combination static plate and clamping ring device depicted in FIG. 1.

Referring now to FIG. 2, which is a front elevation, partially broken away, of high voltage winding 36, core 24, upper clamping bar 26*a*, lower clamping bar 28*a* and outer combination static plate and clamping ring 32*a* depicted in FIG. 1. High voltage winding 36, disposed around and concentric with low voltage winding 38 and with central leg member 40 of magnetic core 24 is supported by lower force distributing plate 42 adjacent the low voltage or lower end of said winding 36, which, in turn, is adjacent to and is supported by lower clamping bar 28*a*. Outer combination static plate and clamping ring 32*a* is disposed around central leg member 40 of core 24 and is immediately adjacent the high voltage or upper end of high voltage winding 36, between said upper end of high voltage winding 36 and upper clamping bar 26*a*. Jackscrew assembly 37*a*, 37*b*, two of several such assemblies, are attached to upper clamping bar 26*a* and maintain a compressive force on combination static plate and clamping ring 32*a*. Combination static plate and clamping ring 32*a* can more adequately be seen in FIG. 3.

Figure 3:
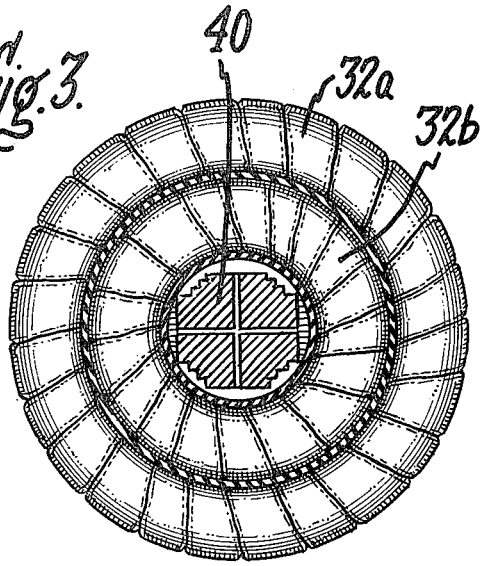
FIG. 3 is a cross-sectional view taken along the line 3—3 in FIG. 2.

Referring now to FIG. 3, which is a cross-sectional view taken along the line 3—3 in FIG. 2, there is shown outer combination static plate and clamping ring 32*a*, inner combination static plate and clamping ring 32*b* and central core leg member 40. Combination static plate and clamping ring device 32*b* is internal of and concentric with outer combination static plate and clamping ring 32*a*; said combination device 32*b* being immediately adjacent inner or low voltage winding 38 (FIG. 2). Both combination device 32*a* and combination device 32*b* have annular openings therethrough, and are disposed concentrically around central leg member 40 of magnetic core 24 (FIG. 2). A force is applied to combination devices 32*a* and 32*b* and eventually to windings 36 and 38 (FIG. 2) by a jackscrew arrangement of the type depicted in FIG. 4.

Figure 4:
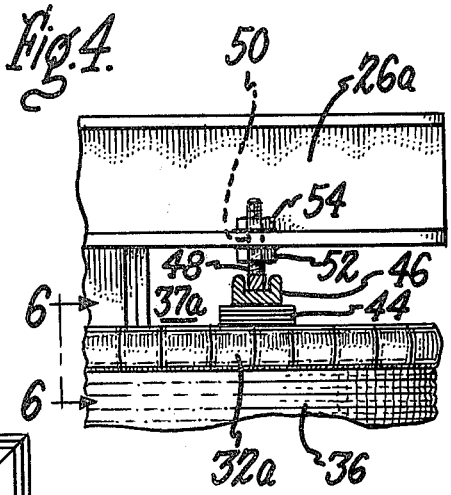
FIG. 4 is an enlarged detail of FIG. 2 showing a jackscrew clamping device used in conjunction with the combination static plate and clamping ring of the present invention.

Referring now to FIG. 4, which is an enlarged detail view of jackscrew assembly 37*a* and adjacent structure depicted in FIG. 2; said assembly 37*a* being only one of several such assemblies spaced around the upper surface of combination devices 32*a* and 32*b* in transformer 20 (FIG. 1), whose function is to generate a compressive force on the axial ends of high and low voltage windings 30 (FIG. 1). Jackscrew assembly 37*a* comprises insulating clamping block 44 positioned adjacent the upper surface of outer combination static plate and clamping ring 32*a*; the lower surface of said combination device 32*a* being adjacent the upper end of high voltage winding 36. Jackscrew foot 46 being cup-shaped at one end has the lower end or the end opposite the cup-shaped end adjacent the upper surface of insulating clamping block 44; the cup-shaped end of jackscrew foot 46 extending upward. Jackscrew 48 has a head end and a threaded end. The lower or head end rests in the upward extending cup-shaped portion of jackscrew foot 46, and the upper or threaded end of jackscrew 48 extends through opening 50 in upper clamping bar 26*a*. By tightening adjusting nut 52 against upper clamping bar 26*a*, a compressive force is applied to the ends of high voltage winding 36. Tightening lock nut 54 on the threaded end of jackscrew 48 against upper clamping bar 26*a* places jackscrew 48 in a fixed position with respect to said upper clamping bar 26*a*.

Figure 5:
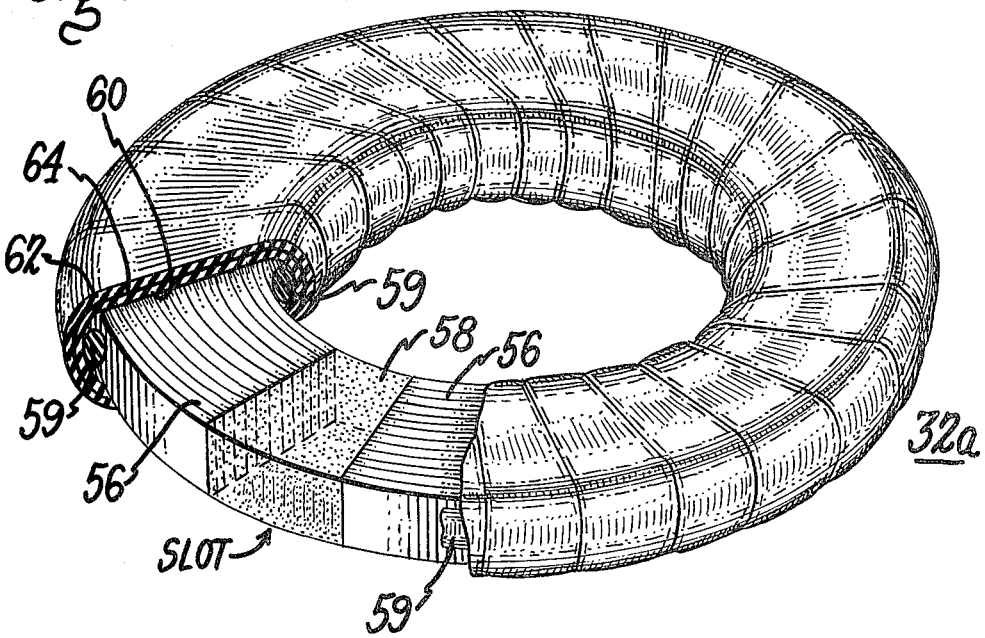
FIG. 5 is a partially broken away perspective view of the combination static plate and clamping ring of the present invention showing a slot in a core-steel strip-type clamping ring, filled with an epoxy resin material.
Figure 6:
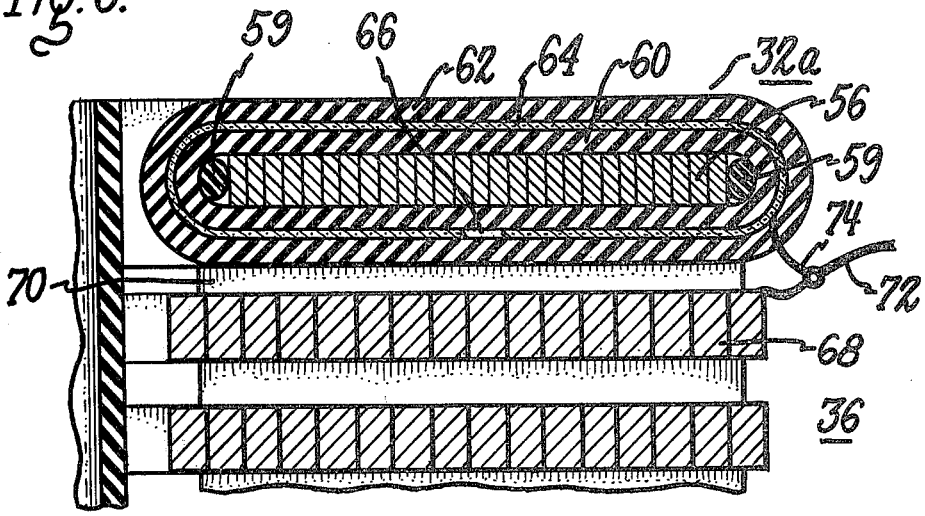
FIG. 6 is a fragmented longitudinal sectional view of the high voltage winding and its associated combination static plate and clamping ring of the present invention, taken along the line 6—6 in FIG. 4.

Reference will now be made to FIG. 5, which is a perspective view, partially broken away, of outer combination static plate and clamping ring 32*a* of the present invention, in a preferred embodiment thereof. Outer combination static plate and clamping ring 32*a* depicted in FIG. 5 is of the form that is used in clamping high and low voltage winding 30 of transformer 20 (FIG. 1). The physical size of this combination device depends on the size of the specific winding to be clamped. Combination static plate and clamping ring 32*a*, depicted in FIG. 5, has a clamping ring 56 that is laminated, said clamping ring being formed of spirally wound core-steel strips in the shape of an annular disc. After said laminated core-steel clamping ring 56 is formed, a slot is cut in same to avoid having a low impedance turn in a magnetic field and the well known undesirable consequences attending such an arrangement. The just-mentioned slot cut in clamping ring 56 is subsequently filled with a high-strength bonding material that is compatible with transformer oil such as epoxy resin 58. Using epoxy resin 58 in such a slot restores the radial strength of clamping ring 56 that was lost when the epoxy filled slot was cut in said clamping ring 56. Forming clamping ring 56 of core-steel strips saves material that would otherwise be discarded as scrap. After clamping ring 56 is formed, has a slot cut in same and is filled with epoxy resin 58, the static plate portion of outer combination static plate and clamping ring 32*a* is assembled on clamping ring 56; said clamping ring 56 and rope-like kraft paper 59, adjacent the inner and outer edges of said clamping ring 56 being used as a foundation ring for said static plate. FIG. 6 more clearly illustrates the relationship between clamping ring 56 and the static plate assembled thereon.

Referring now to FIG. 6, which is a fragmentary longitudinal sectional view of high voltage winding 36 and outer combination static plate and clamping ring 32*a* assembled thereon, taken along the line 6—6 in FIG. 4. Kraft-paper tape 60 is radially wrapped around clamping ring 56 and rope-like kraft paper 59 adjacent the inner and outer edges of clamping ring 56, to form a layer of electrical insulation around said clamping ring 56. After kraft paper 60 has been applied to clamping ring 56, paper tape 62, having an aluminum foil backing 64, is radially wrapped around kraft paper 60 with space 66 left where the two ends of the aluminum foil meet to avoid the undesirable consequences of having a low impedance turn in a magnetic field. Combination static plate and clamping ring 32*a* is placed adjacent spirally wound disc coil 68 of high voltage disc winding 36 and a plurality of compressible spacers 70, made of electrical insulating material, are interposed between the upper surface of disc coil 68 and the lower surface of combination device 32*a*. Spacers 70 are spaced, circumferentially, around said upper surface of coil 68 for the optimum transfer of compressive forces to winding 36 that have been applied to combination static plate and clamping ring 32*a*. Aluminum foil backing 64 is connected to high voltage winding leads 72 by electrical conductor 74.

DISCUSSION

In the preferred embodiment, a single, power transformer winding having high and low potential ends is described. In this type of winding, a single combination static plate and force distributing member or clamping ring is used at the upper or high potential end and a support or force distributing member that does not incorporate a static plate is utilized at the lower or low potential end of the winding. The lower force distributing member has substantially the same high strength characteristics as the combination static plate and clamping ring at the opposite end of the winding. A static plate is not incorporated in the lower force distributing member at the low potential end of the winding because it would provide no useful function. However, in some winding arrangements, as in three-phase delta connected windings, both ends of a winding are high potential ends. In winding arrangements where both ends of a winding are high potential ends, a combination static plate and clamping ring of the type described herein, would be used at both ends of such a winding.

Foundation ring 56 described in the preferred embodiment is made from core-steel strips that have been spirally wound, radially outward, or radially inward and are bonded together for strength with an epoxy resin; said ring having an annular opening along the axis around which said core-steel strips have been wound. The slot cut in spirally wound ring 56 is made after the entire foundation ring is wound; it being unnecessary and undesirable to cut the core-steel strip after each complete spiral turn. In addition, foundation ring material other than core-steel strips may be utilized. The material may be of metal or of non-metal and if of metal, the material may be magnetic or non-magnetic. The primary requirement for the foundation ring material is that it be able to distribute the force applied to it, to the winding to be compressed, in a reasonably even manner.

I claim:

1. In electric induction apparatus of the type having, a housing, a magnetic core including a plurality of legs, said magnetic core being mounted internal of and in a fixed relation with respect to said housing, a cylindrical winding having upper and lower ends incorporating a plurality of radially spaced-apart coils, said winding being disposed around a leg of said magnetic core in an electrically insulated relationship thereto, first clamping support structure proximate to said upper end and second clamping support structure proximate to said lower end of said winding, said first and second clamping support structure being in a fixed relation with respect to said magnetic core and said housing, a lower force distributing member positioned between said lower end of said winding and said second clamping structure, wherein the improvement comprises:

a. a foundation ring formed of concentrically positioned, generally circular, core-steel strips, adjacent surfaces of said core-steel strips being held together by bonding means, said foundation ring having a slot extending completely through said foundation ring in a generally radial direction;

b. electrically conductive material placed on and electrically insulated from said foundation ring, for connection to a high voltage terminal of said electrical induction apparatus; and c. force generating means reacted between the combination of said foundation ring and said electrically conductive material, and said first clamping support structure for the applicaton of a compressive force to the upper and lower ends of said winding.

2. An electrical induction apparatus as defined in claim 1 wherein said device further comprises:

a. that said concentric core-steel strip, adjacent surfaces of said core-steel strip being boned core-steel strips are formed of at least one spirally wound core-steel strip, adjacent epoxy resin; and b. a high-strength bonding material placed in said slot to restore a portion of the radial rigidity of said ring, the loss of which was caused by cutting said slot in same.

3. An electrical induction apparatus as defined in claim 2 wherein said high-strength material is an epoxy resin.

4. An electrical induction apparatus as defined in claim 1 wherein said force generating means comprises a jackscrew.

5. An electrical induction apparatus as defined in claim 1, wherein each of a plurality of concentrically positioned windings of the type described therein has a separate, concentrically positioned combination static plate and force distributing member placed at the end of said windings and unequal compressive forces are applied along the longitudinal winding axis of at least two of such windings.

6. An electrical induction apparatus as defined in claim 1, wherein a delta connected winding of the type described therein, having a high voltage at each end, has a combination static plate and force distributing member device placed at opposite ends of such winding.

* * * * *

UNITED STATES PATENT OFFICE
CERTIFICATE OF CORRECTION

PATENT NO. : 3,983,523

DATED : September 28, 1976

INVENTOR(S) : Ralph E. Ayers

It is certified that error appears in the above-identified patent and that said Letters Patent are hereby corrected as shown below:

Column 6, lines 35 - 38, change "that said concentric core-steel strip, adajacent surfaces of said core-steel strip being boned core-steel strips are formed of at least one spirally wound core-steel strip, adjacent epoxy resin; and" to -- that said concentric core-steel strips are formed of at least one spirally wound core-steel strip, adjacent surfaces of said core-steel strip being bonded together with an epoxy resin; and --.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*